United States Patent [19]

Carrieri

[11] 4,339,975

[45] Jul. 20, 1982

[54] SHOCK DAMPENING SYSTEM FOR PRESSES

[75] Inventor: Louis F. Carrieri, LaGrange Park, Ill.

[73] Assignee: Gulf & Western Manufacturing Company, Southfield, Mich.

[21] Appl. No.: 198,435

[22] Filed: Oct. 20, 1980

[51] Int. Cl.[3] ..... B26D 5/12

[52] U.S. Cl. ..... 83/617; 83/639; 267/119

[58] Field of Search ..... 83/617, 639; 267/119, 267/118, 130, 137

[56] References Cited

U.S. PATENT DOCUMENTS

| | | | |
|---|---|---|---|
| 2,278,713 | 4/1942 | Riddle | 83/639 X |
| 2,981,136 | 4/1961 | Legge | 83/632 |
| 3,205,749 | 9/1965 | Schenk | 83/639 |
| 3,487,736 | 1/1970 | Kaiser et al. | 83/13 |
| 3,827,328 | 8/1974 | LaFlamme et al. | 83/617 |
| 4,214,496 | 7/1980 | Carrieri | 83/617 |

FOREIGN PATENT DOCUMENTS

| | | | |
|---|---|---|---|
| 2512822 | 9/1976 | Fed. Rep. of Germany . | |
| 2653714 | 3/1978 | Fed. Rep. of Germany | 83/617 |

*Primary Examiner*—James M. Meister

*Attorney, Agent, or Firm*—Meyer, Tilberry & Body

[57] ABSTRACT

An improved hydraulic fluid shock dampening system is disclosed for a shearing press to minimize shock loading vibration, and the level of noise emanating upon breakthrough of the material being sheared. The system includes cylinder and piston units interposed between the press bed and slide, each providing a variable volume fluid receiving chamber from which fluid under pressure is expelled during movement of the slide toward the bed to achieve a shearing operation. A flow sensitive valve in communication with the chambers has a first fixed flow rate thereacross during the shearing operation, and prior to breakthrough, and is responsive to accelerated movement of the slide upon breakthrough to provide a second and substantially lower fixed flow rate thereacross during completion of the movement of the slide toward the press bed.

13 Claims, 4 Drawing Figures

SHOCK DAMPENING SYSTEM FOR PRESSES

BACKGROUND OF THE INVENTION

The present invention relates to the art of presses and, more particularly, to a hydraulic fluid shock dampening system for a shearing press.

In a shearing press, as is well known, cooperable cutting die or shearing components are mounted on the press slide and bed to achieve cutting or shearing of material therebetween in response to movement of the press slide through the downward portion of its total stroke. Upon engagement of the die component on the slide with the material to be severed, a load is placed on the press which progressively increases to a maximum which is reached at the point of breakthrough of the shearing components with respect to the material therebetween. This load is imposed on the press through the slide, and movement of the slide toward the press bed is thus restrained during the severing operation. This restraint is removed upon breakthrough, whereupon slide movement toward the press bed is accelerated as a result of the load build up. In the absence of a restraining force with respect to such accelerated movement of the slide, shock loads including negative load forces are imposed on the press together with vibration forces, whereby unacceptable noise emanates from the press during operation thereof. It will be appreciated, of course, that these undesirable characteristics are repeated with each stroke of the press, and that shock loads and vibration are detrimental to press life as well as maintenance expenses in connection with component parts of the press. It will be further appreciated that high noise level is detrimental to the hearing of personnel working the press or working in the vicinity thereof. Vibration and high noise levels are also objectionable from the standpoint of other physiological effects on personnel, as well as psychological effects, and it is of course well known that these problems are of such a magnitude, and the potential detrimental effects thereof are of such concern, that government regulations have been established with respect to noise levels.

Many efforts have been made heretofore to dampen shock loads and vibrations in shearing presses, and in my U.S. Pat. No. 4,214,496, issued July 29, 1980, there is disclosed a hydraulic shock dampening system for shearing presses which provides a high degree of efficiency with regard to reducing shock load by eliminating negative load forces on the press upon material breakthrough. While such elimination of negative loading results in reducing shock loading and vibration, and thus advantageously promotes longer press life and lower maintenance costs, it has been found that the system vibrates at sonic frequencies following breakthrough, whereby the noise of operation while reduced is still undesirably high. In accordance with my earlier system, a flow sensitive valve having open and closed modes is in fluid flow communication with a hydraulic fluid receiving damping chamber interposed between the press slide and bed. The valve remains open and provides restricted fluid flow from the damping chamber at a fixed flow rate with minimal pressure drop during movement of the shearing component through the material being sheared and, at the point of breakthrough, acceleration of the slide quickly and positively shuts the valve to prevent any fluid flow from the chamber. Such stopping of flow from the damping chamber produces a rapid counterload against slide movement, thus reducing the energy release experienced at breakthrough. Accordingly, the load is maintained on the press through the slide following breakthrough, whereby negative loading of the press is eliminated and shock loading and vibration forces are reduced in comparison with other dampening systems. Initiating fluid flow across the valve prior to material breakthrough is important in that it establishes a directional flow of fluid through the system to avoid shock, vibration and resulting bouncing in the damping chamber and hydraulic system in response to the sudden closing of the flow sensitive valve and, more importantly, because it assures operation of the system immediately upon breakthrough. In this respect, it is the immediate response of the valve at the point of breakthrough and the sudden change from low pressure drop flow across the valve which provides the desired immediate counterload against slide movement and thus elimination of negative loads following breakthrough.

SUMMARY OF THE INVENTION

In accordance with the present invention, an improvement is provided in connection with my hydraulic shock dampening system described above and by which the reduction in shock loading and vibration achieved with my earlier system are further reduced in a manner whereby both the levels and durations thereof are minimized. Accordingly, the noise level during press operation and the duration of noise following material breakthrough are both considerably reduced, and all of these characteristics are achieved while advantageously maintaining elimination of negative loading of the press. More particularly in accordance with the present invention, the flow sensitive valve remains open during movement of the shearing component through the material being sheared, as in my earlier system, so as to establish flow from the damping chamber with minimal pressure drop during the cutting operation up to the point of breakthrough. Upon breakthrough, the flow sensitive valve is immediately displaced to a second position in which the valve, in accordance with the improvement of the invention, provides restricted flow from the damping chamber through a fixed orifice or restricted passageway with a considerably higher pressure drop across the valve during completion of the movement of the slide toward the press bed. The rapid response of the flow sensitive valve together with the high pressure drop thereacross in the second position produces the desired rapid counterload against slide movement to eliminate negative loading of the press and reduce shock loading and vibration, as in my earlier system, and the magnitude of the restricted flow across the valve in the second position advantageously further reduces the shock loading and vibration levels and the durations thereof in comparison with my earlier system. Such further reductions in these characteristics not only promote the life of the press and reduce maintenance costs but, importantly, result in reducing the noise level and the duration thereof following breakthrough.

It is accordingly an outstanding object of the present invention to provide an improved hydraulic shock dampening system of the character including a fluid flow sensitive valve controlling flow of hydraulic fluid from a variable volume damping chamber between the press bed and slide in response to breakthrough of material being severed.

Another object is the provision of an improved shock dampening system of the foregoing character which is highly efficient with respect to minimizing shock loading and vibration and thus noise level during press operation.

Yet another object is the provision of a shock dampening system of the foregoing character in which a flow sensitive valve provides a fixed flow passage from the damping chamber at a low pressure drop across the valve during movement of the shearing component through the material being sheared and which, upon breakthrough, immediately provides for fluid flow from the damping chamber to be at a substantially higher pressure drop across the valve to eliminate negative loading of the press and to minimize the magnitudes and durations of shock loading and vibration forces and thus the noise level of press operation.

Still another object is the provision of a shock dampening system of the foregoing character which is inexpensive to manufacture and install and which is highly efficient in operation throughout long periods of continuous use, thus minimizing down time of the press and maintenance time and expense.

BRIEF DESCRIPTION OF THE DRAWINGS

The foregoing objects, and others, will in part be obvious and in part pointed out more fully hereinafter in conjunction with the written description of a preferred embodiment of the invention shown in the accompanying drawings in which.

DESCRIPTION OF A PREFERRED EMBODIMENT

Figure 1:
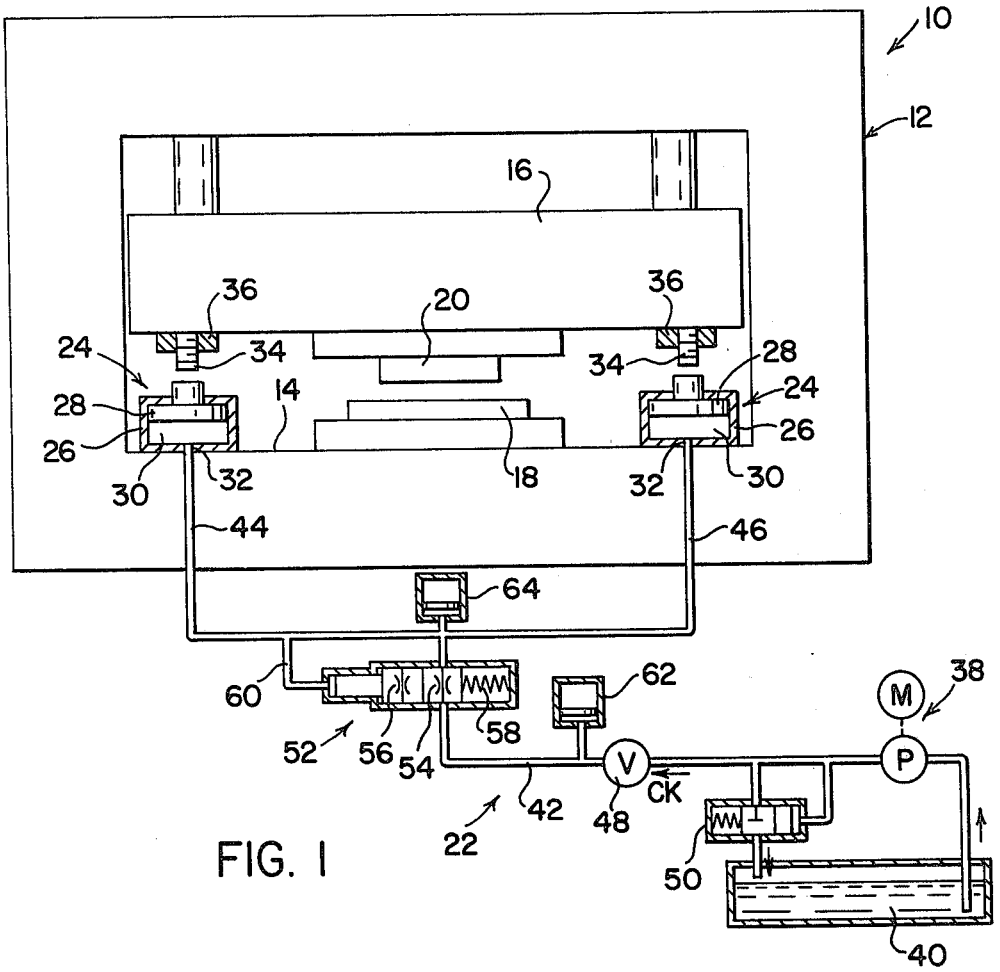
FIG. 1 is a schematic illustration of a shock dampening system in accordance with the present invention associated with the slide and bed components of a shearing press.

Referring now in greater detail to the drawings wherein the showings are for the purpose of illustrating a preferred embodiment of the present invention only and not for the purpose of limiting the invention, a hydraulic fluid shock dampening system is schematically illustrated in FIG. 1 and in conjunction with a shearing press 10 operable, for example, to cut blanks from metal sheets. The structure and operation of presses of this character are of course well known in the art, and details regarding the structure and operation are not necessary to an understanding of the present invention. It will be sufficient to appreciate that the press has a frame 12 providing a press bed 14 and that the frame supports a slide 16 for reciprocation toward and away from bed 14, a suitable drive arrangement being provided to achieve such reciprocation. As is further well known in the shearing press art, bed 14 supports a shearing component 18 and slide 16 supports a shearing component 20 cooperable with component 18 to cut material therebeneath during downward movement of slide 16 to the bottom dead center position thereof. Cutting takes place, of course, from a point along the slide stroke above the bottom dead center position at which shearing component 20 engages the material to a second point along the slide path just ahead of bottom dead center and at which shearing components 18 and 20 cooperatively breakthrough the material being cut. As is well known to those skilled in the art of presses, engagement of material to be cut between shearing components 18 and 20 during downward movement of the slide imposes a load on the press through the slide and which load is suddenly released upon breakthrough of the material, whereupon downward movement of the slide is accelerated in the direction toward the bottom dead center position thereof. This is of course accompanied by release of the energy stored by loading of the press during the shearing operation.

A shock dampening system in accordance with the present invention, designated generally by the number 22 in FIG. 1, is a hydraulic system including hydraulic fluid receiving variable volume dampening chamber devices 24 mounted on or supported relative to the press bed for actuation by slide 16 during downward movement thereof toward the bottom dead center position. In the embodiment shown, each variable volume device 24 is in the form of a piston-cylinder assembly including a cylinder 26 supported on the press bed and a piston 28 supported within cylinder 26 for vertical reciprocation relative thereto. The space in cylinder 26 behind piston 28 defines a fluid receiving chamber 30, and cylinder 26 is provided with a common inlet and outlet passage 32 opening into chamber 30. Slide 16 carries an actuator pin 34 for each piston, and each pin 34 has its upper end threadedly interengaged with a support collar 36 on the slide so that the pin is vertically adjustable relative to the slide for the purpose set forth hereinafter.

Chambers 30 of variable volume devices 24 are connected to a common source of hydraulic fluid under pressure. More particularly in this respect, a motor-pump unit 38 is adapted to deliver hydraulic fluid under pressure to chambers 30 from a source 40 through a flow line system including a flow line 42 and branch lines 44 and 46 connected thereto and to one of the passageways 32 of variable volume devices 24. A one-way check valve 48 prevents backflow to source 40, and a pressure responsive unloading valve 50 is operable at a predetermined pressure between valve 48 and the motor-pump unit to return hydraulic fluid to the source when valve 48 is closed and the pressure between the latter valve and motor-pump unit 38 exceeds the setting of valve 50.

A fluid flow sensitive valve 52 is provided in flow line 42 to control fluid flow through the latter line. Valve 52 includes a first restricted passageway 54 providing for a first restricted fluid flow thereacross in the direction between chambers 30 and source 40 when valve 52 is in a first position illustrated in FIG. 1 in which passageway 54 is in alignment with flow line 42. Valve 52 further includes a second and smaller restricted passageway 56 providing for a second restricted fluid flow thereacross in the direction from chambers 30 toward source 40 and which flow takes place when valve 52 is shifted to the right in FIG. 1 to a position in which restricted passageway 56 is in alignment with flow line 42. The relative sizes of passageways 54 and 56 and the respective functions thereof are set forth hereinafter in connection with the description of the operation of the system. Valve 52 is normally biased to the position shown in FIG. 1 by a spring 58, and is adapted to be displaced to the right in FIG. 1 by fluid under pressure from branch lines 44 and 46 acting thereagainst through a feed line 60, as described in greater detail hereinafter. A low pressure hydraulic fluid receiving accumulator 62 is connected to flow line 42 between valves 48 and 52, and a high pressure hydraulic fluid receiving accumulator 64 is connected in fluid communication with line 42 and branch lines 44 and 46 between valve 52 and chambers 30 of variable volume devices 24.

Figure 2:
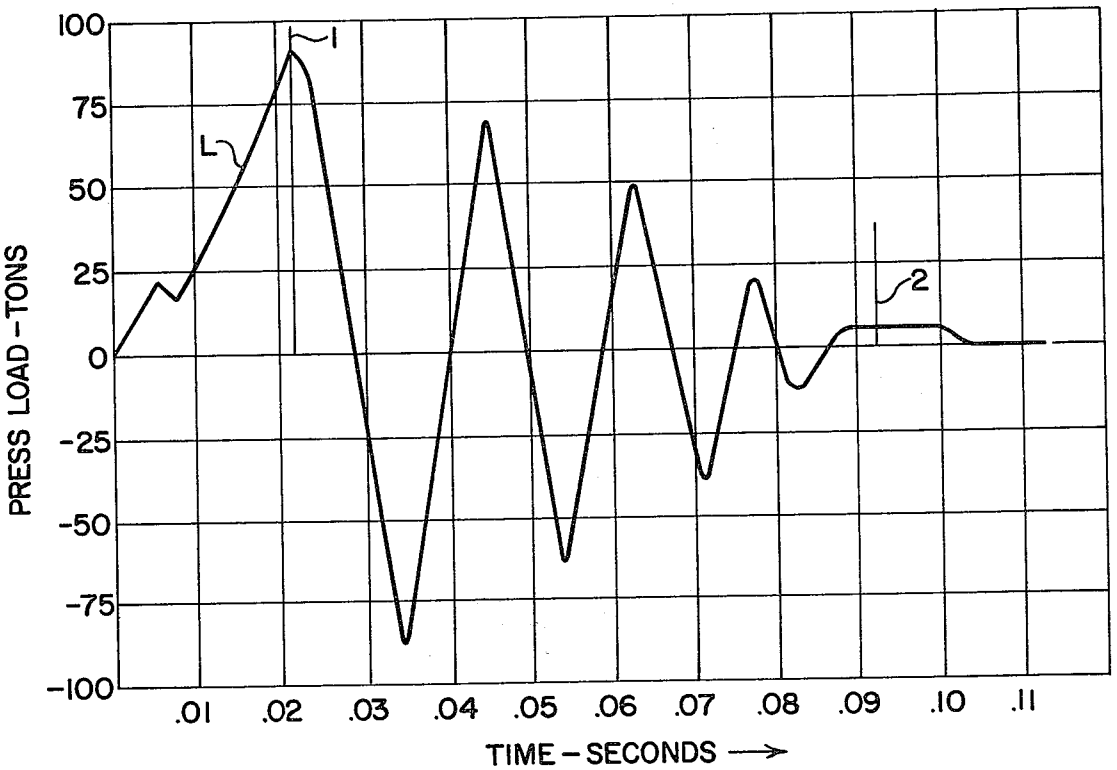
FIG. 2 is a graph showing the press load curve during the working stroke of a shearing press without shock dampening.
Figure 3:
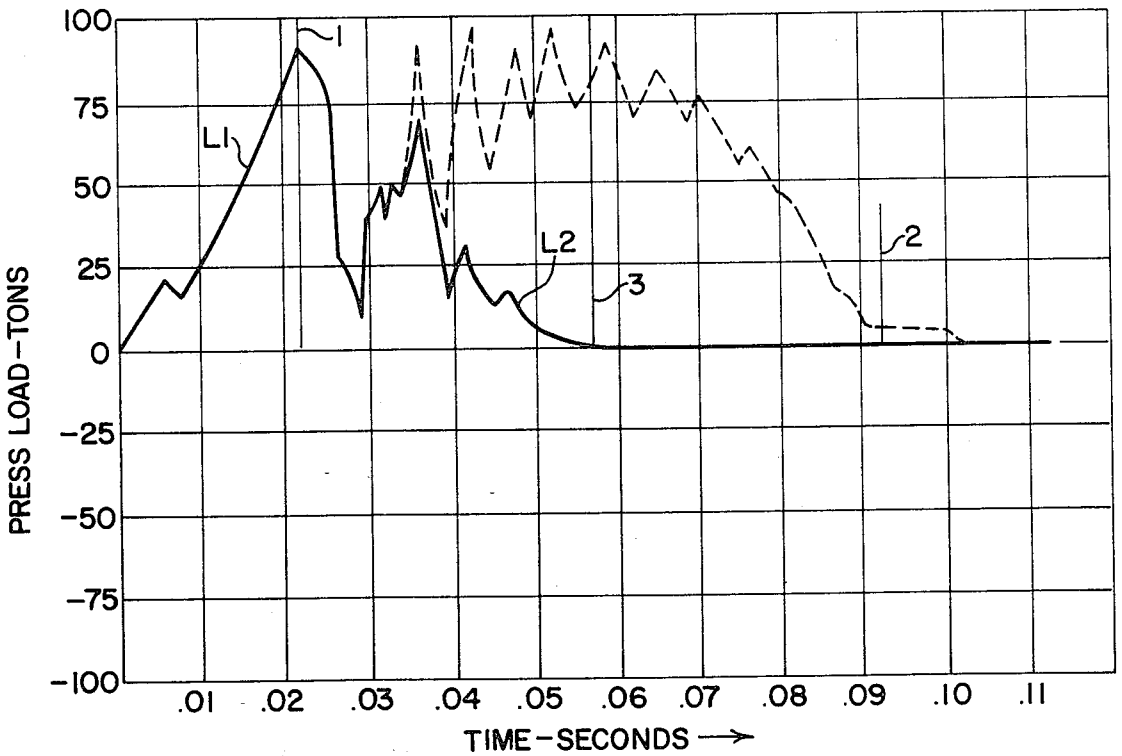
FIG. 3 is a graph showing press load curves for a shearing press with and without the improvement provided in accordance with the present invention; and, FIG. 4 is a sectional elevation view illustrating a flow sensitive valve in accordance with the present invention structurally associated with the fluid receiving damping chamber and accumulator components of the shock dampening system.

Operation of the shock dampening system described above in connection with eliminating negative loading of the press and minimizing the magnitudes and durations of shock loading and vibration forces in the press will be best understood by referring to FIGS. 2 and 3 of the drawing together with FIG. 1. Briefly, FIGS. 2 and 3 are graphs showing slide loads and the durations thereof in connection with movement of the slide through the shearing stroke. FIG. 2 shows the effect of no shock dampening of the slide, and FIG. 3 shows the effect of the shock dampening system disclosed in my aforementioned patent in comparison with the improved system according to the present invention. Both graphs are based on the operation of a one-hundred ton, two point press operating with a blanking die at one-hundred and eighty-five strokes per minute, and the graphs in FIG. 3 are based on actual oscilloscope traces during testing of the latter press. In the graphs of FIGS. 2 and 3, the time coordinate is measured from the point of engagement of the shearing components with the material to be severed, line 1 represents the time at which breakthrough of the material by the shearing components occurs, and line 2 represents the time following material breakthrough at which the slide has descended through its bottom dead center position and returned to the level of breakthrough. Curve L in the graph in FIG. 2 represents the load imposed on the press during a severing operation without shock dampening, curve L1 in FIG. 3 represents the load imposed on the press employing the shock dampening system disclosed in my aforementioned patent, and curve L2 in the latter Figure represents the load imposed on the press with the improved shock dampening system according to the present invention.

It will be appreciated with respect to the curves in the graphs of FIGS. 2 and 3 that reversal of the directions of the curves is representative of reverse loading and thus vibration, and that shock loading is indicated by the sharpness of the changes in directional loading.

With the foregoing in mind, and with regard to the operation of the shock dampening arrangement described hereinabove, the components of the press and hydraulic system are in the positions illustrated in FIG. 1 prior to a shearing operation. Hydraulic fluid is delivered under pressure from source 40 to chambers 30 through flow line 42, restricted passage 54 of valve 52 and branch lines 44 and 46, and the fluid under pressure in chambers 30 biases pistons 28 upwardly. As slide 16 moves downwardly toward bed 14, pins 34 engage pistons 28 just before shearing components 18 and 20 engage the material to be severed. The adjustability of pins 34 enables setting the pins in this respect. Once the pins engage the pistons, continued downward movement of slide 16 causes downward movement of pistons 28 in cylinders 26 forcing hydraulic fluid from chambers 30 into branch lines 44 and 46 through cylinder passages 32. This fluid from chambers 30 flows back toward source 40 through first restricted passage 54 of valve 52 and, since one way valve 48 is closed against return of fluid to source 40, low pressure accumulator 62 receives the backflow fluid under pressure and stores the latter for return towards chambers 30 as set forth hereinafter. Pins 34 are set to engage pistons 28 prior to engagement of the shearing components with the material to be severed to establish actuation of variable volume devices prior to material breakthrough, thus to assure immediate displacement of valve 52 to the right in FIG. 1 upon material breakthrough. The velocity of the slide at this time is a known factor in connection with a given press, and first restricted passageway 54 of valve 52 is dimensioned for this velocity to produce a minimal pressure drop across the valve, the opening bias of spring 58 being sufficient to maintain valve 52 in the first position thereof shown in FIG. 1. The low pressure drop and the fixed area of the passageway 54 advantageously provide for the desired establishment of fluid flow across the valve prior to breakthrough without imposing hydraulic fluid resistance to slide movement as a result of fluid pressure in variable volume devices 24.

As mentioned hereinabove, the shearing components engage the material to be severed at the beginning of the time coordinates in FIGS. 2 and 3. As will be seen from load curves L, L1 and L2 in FIGS. 2 and 3, the press is then loaded from zero to a maximum as the shearing components move through the material during the period of slide displacement to line 1 representing the point of material breakthrough. It will be appreciated that this loading of the press restrains advancement of the slide toward the bottom dead center position thereof, thus storing considerable energy which is released at the point of breakthrough. Upon material breakthrough at the point of line 1, the load is suddenly removed from the press and the stored energy of the load is imposed on the slide causing a rapid acceleration of the slide towards its bottom dead center position. In the absence of any shock dampening of the slide at this point, the slide is immediately accelerated to bottom dead center, thereby imposing shock on the press and bounce of the slide resulting in the imposition of a series of positive and negative loads on the press, indicated by curve L in FIG. 2, and which positive and negative loads continue throughout the period of time required for the slide to return to the level of breakthrough, as represented by line 2 in the graphs. Such loading is of course detrimental to the press and tooling, and shock loading and vibration forces during the period of time between lines 1 and 2 of the graphs is especially detrimental to the tooling in that the tooling and workpiece are in engagement during this period.

A shock dampening system in accordance with the present invention advantageously restrains slide displacement toward bottom dead center following material breakthrough to eliminate negative loading and, additionally, minimizes shock loads and vibration and the durations thereof during completion of the severing operation and return of the slide to the level of breakthrough. In this respect, with reference to FIG. 1, acceleration of the slide which occurs upon breakthrough is transmitted to pistons 28, thus suddenly accelerating displacement of the pistons in the direction to reduce the volume of chambers 30. This sudden displacement increases the velocity of the hydraulic fluid flowing from chambers 30, whereby valve 52 is actuated through feed line 60 and is immediately displaced to the right in FIG. 1 to displace second restricted passageway 56 into alignment with flow line 42. In this respect, the area of passageway 54 which provides for the low pressure drop flow across the valve prior to breakthrough, as described above, is at the same time sufficiently small for the valve to immediately respond to the sudden increase in the velocity of fluid flow at the point of breakthrough.

In the system disclosed in my aforementioned patent, displacement of the flow sensitive valve in the foregoing manner at the point of material breakthrough completely closed flow line 42 and thus prevented any fluid flow from chambers 30. Such closing of the flow sensitive valve causes the imposition of a counterload on the slide through chambers 30 and which counterload eliminates negative loading of the press, as will be seen from curve L1 in the graph of FIG. 3 representing press load with my earlier system. At the same time, it will be seen from curve L1 that considerable shock loading and vibration continues to be imposed on the press as the slide moves through its bottom dead center position and back to the level of breakthrough, as represented by line 2 in the graph.

In accordance with the present invention, displacement of valve 52 to position restricted passageway 56 into alignment with flow line 42 provides for fluid flow across the valve upon breakthrough to be at an extremely high pressure drop to thereafter dissipate the damping energy in chambers 30. Fluid flowing through passageway 56 is of course received in low pressure accumulator 62. In comparison with my earlier system, it will be seen from curve L2 in the graph of FIG. 3 that such displacement of valve 52 provides for eliminating negative loading of the press following breakthrough and, additionally, substantially reducing the shock loading and vibration which occurred following breakthrough with my earlier system. More particularly, such shock loading and vibration are reduced to zero at the point represented by line 3 in FIG. 3 and which point is well in advance of the return of the slide to the level of breakthrough represented by line 2. As mentioned hereinabove, the curves in the graph of FIG. 3 are based on actual oscilloscope traces, and it will be seen from FIG. 3 that, immediately following material breakthrough, the difference between press loading with my earlier system and with the present improvement is indescernible, whereas the difference with respect to the magnitudes and durations of shock loading and vibration following the first reversal of press loading is substantial and is clearly evident. It will be appreciated, therefore, that the sudden change in fluid pressure in the system in response to the rapid displacement of valve 52 to its second position enables maintaining elimination of negative press loading as with my earlier system, the second restricted passageway 56 in the valve being of sufficiently small area to provide a high pressure drop across the valve to avoid losing this feature while, at the same time, dissipating dampening energy at a rate which provides for reducing the magnitudes and durations of the shock loading and vibration forces imposed on the press following material breakthrough. It will be appreciated too that such reductions of the loading and vibrating forces provides considerable reduction in the level of noise during press operation.

Upon upward movement of slide 16, the fluid pressure in the system biases pistons 28 upwardly to reduce system pressure and thus provide for spring 58 to displace valve 52 to the left from the second position thereof to the first position shown in FIG. 1. As the fluid pressure decreases, fluid accumulated under pressure in accumulator 62 is released to flow through valve 52 back into branch lines 44 and 46 and chambers 30 to fully bias pistons 28 to their uppermost positions. Motor-pump unit 38 is operable to replenish any fluid leakage from the system which might occur during operation of the press.

High pressure accumulator 64 is a safety device to prevent damage as a result of press overload. If, for example, there is some breakdown which causes the press slide to impose a high pressure on the hydraulic system between piston-cylinder units 24 and check valve 48, accumulator 64 is actuated to receive fluid under such excess pressure.

Figure 4:
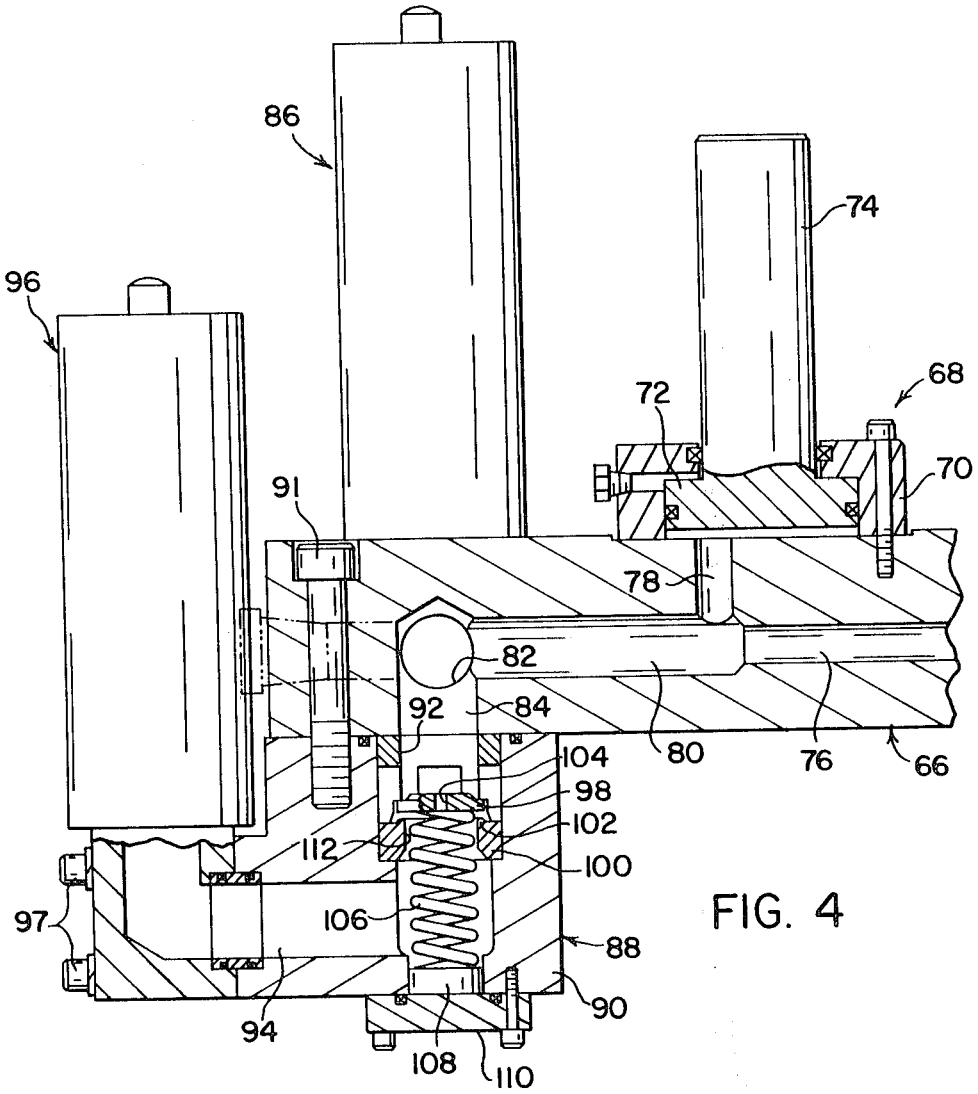

A structural embodiment of a shock dampening system in accordance with the present invention and showing a flow sensitive valve providing the foregoing operating characteristics is illustrated in FIG. 4 of the drawings wherein component parts of the system are shown associated with a bolster plate mountable on a press bed. With regard to the latter Figure, the bolster plate 66 is adapted to be removably mounted on a press bed, not shown, and supports variable volume fluid receiving chamber devices corresponding to the devices 24 in FIG. 1, only one of which is visible in FIG. 4 and is designated generally by the number 68. Each of the chamber devices 68 includes a cylinder member 70 bolted to the bolster plate and a piston member 72 reciprocably received therein and having a piston rod portion 74 extending vertically upwardly therefrom. It will be appreciated that piston rod portions 74 are each axially aligned with a corresponding actuator on the press slide, not shown in FIG. 4, and in the manner illustrated in FIG. 1 with respect to actuator pins 34 and pistons 28 of chamber devices 24.

Bolster plate 66 is provided with an internal passageway 76 connected to the source of hydraulic fluid, not shown, and to variable volume chamber device 68 by means of a passageway 78 therebetween. It will be appreciated that passageway 76 is similarly connected to the second variable volume device on the bolster plate, and that passageway 76 and connecting passageway 78 correspond to flow lines 44 and 46 in FIG. 1. The bolster plate is further provided with a passageway 80 communicating passageways 76 and 78 and thus the variable volume chamber devices 68 with further passageways 82 and 84. Passageway 82 opens into a high pressure accumulator 86 and passageway 84 opens into flow sensitive valve 88. Accumulator 86 and valve 88 correspond respectively to accumulator 64 and valve 52 in FIG. 1, and passageway 84 corresponds to flow line 60 in FIG. 1.

Valve 88 includes a housing 90 mounted on the bolster plate by means of bolts 91. Housing 90 includes an entrance passageway 92 communicating with passageway 84 and a discharge passageway 94 communicating with a low pressure fluid accumulator 96. Accumulator 96 is mounted on valve housing 90 by means of bolts 97 and corresponds to accumulator 62 in FIG. 1, and discharge passageway 94 corresponds to flow line 42 in the latter Figure. Flow sensitive valve 88 includes a valve element 98 reciprocably supported in housing 90 in a sleeve 100 therein which provides a valve seat 102 for valve element 98. Valve element 98 is in the form of a flat circular disc having an opening 104 centrally therethrough, and the valve element is normally biased away from valve seat 102 by means of a coil spring 106 interposed between the downstream side of valve element 98 and a plug 108 removably supported in the housing. The lower end of sleeve 100 provides a discharge passageway 112 which defines the first restricted passageway for the flow sensitive valve as described hereinabove and which corresponds to restricted passageway 54 in valve 52 in FIG. 1. Opening 104 through valve element 98 provides the second restricted passageway for the flow sensitive valve and corresponds to second restricted passageway 56 of valve 52 in FIG. 1.

From the foregoing description of FIG. 4, it will be appreciated that passageway 76 is adapted to be connected to a flow line from a source of hydraulic fluid under pressure such as that defined by motor-pump unit 38, source 40, check valve 48 and unloading valve 50 in the system shown in FIG. 1. It will be further appreciated that fluid flow from the source enters variable volume chamber devices 68 through passageway 76, enters accumulator 86 through passageway 82, and enters accumulator 96 through passageway 84, valve 88 and passageway 94. At the beginning of a shearing operation, pistons 72 are displaced downwardly as a result of the engagement of the actuators on the press slide with piston rods 74, and spring 106 in valve 88 maintains valve element 98 away from seat 102 to permit fluid flow across the valve at a first and low pressure drop to low pressure accumulator 96 prior to breakthrough of the material being sheared. Upon breakthrough and the resulting acceleration of the press slide, pistons 72 are accelerated downwardly in chambers 70 and the resulting increased velocity of fluid flow through inlet passageway 92 of valve 88 rapidly closes valve element 98 against seat 102. Upon such closing of valve element 98 against seat 102, the fluid flow through opening 104 provides a second and high pressure drop across the valve determined by the size of opening 104 and the slide velocity and which second pressure drop is extremely high in comparison with the first pressure drop, whereby shock loading and vibration forces are further dampened during completion of the downward movement of the slide toward the press bed. Upon the ensuing upward movement of the press slide, spring 106 displaces valve element 98 away from seat 102, and the fluid under pressure in accumulator 96 flows back through valve 88 to re-load the variable volume chamber devices 68 for the next shearing operation. As explained in connection with the system shown in FIG. 1, high pressure accumulator 84 is a safety mechanism operable in response to an overload on the press which would impose an abnormally high pressure on the hydraulic system.

As mentioned hereinabove, the graphs of FIGS. 2 and 3 are based on a one-hundred ton metal blanking press operating at one-hundred and eighty-five strokes per minute. In connection with the foregoing operating characteristics of the system providing the results illustrated in FIG. 3, the press slide has a velocity of nine inches per second just prior to engagement of the shearing tool thereon with the workpiece to be severed and, thus, upon engagement of the actuating pins on the slide with the pistons of the variable chamber devices. The fluid flow responsive valve is similar to valve 88 illustrated in FIG. 4 and includes a valve disc 98 having a diameter of 2.250 inches and a passageway 112 beneath the valve seat having a diameter of 2.000 inches. Orifice 104 has a diameter of from about 0.4375 to 0.500 inch, and the valve disc is spaced from seat 102 by spring 106 in the position shown in FIG. 4 a distance to provide for the flow path across the valve in the latter position to have an area about four times the area of the flow path in the second position of the valve as defined by the area of orifice 104. The shock dampening system is charged at a pressure of about 25 psi, and the pressure drop across the valve in the first position thereof illustrated in FIG. 4 at the aforementioned slide velocity of nine inches per second is about 32 psi. Valve spring 106 has a biasing force which provides for the valve disc to close against seat 102 at a pressure drop across the valve of about 70 psi, and the latter pressure drop is reached when the slide velocity is about thirteen inches per second. Accordingly, it will be appreciated that the spring bias maintains the valve open when the actuating pins first engage the pistons of the variable chamber devices, and through the severing of the material between the press tooling. At the point of material breakthrough, the sudden release of the slide results in a slide velocity of about twenty-one inches per second whereby the 70 psi pressure drop across the valve is immediately exceeded so that the valve disc is closed against seat 102. Response time for the valve in this respect is about 0.001 second, and such rapid closing as explained hereinabove results in eliminating negative loading of the press following breakthrough. At the point of breakthrough, the second restricted passageway defined by orifice 104 in valve 88 provides for the pressure drop across the valve to be as much as 2,400 psi. The latter pressure drop of course decreases following breakthrough in that the slide is decelerating as it approaches the bottom dead center position. At the same time, it will be appreciated that the second restricted passageway is of fixed dimension, and together with deceleration of the slide, advantageously dampens energy release from the dampening cylinders to reduce shock loading and vibration to zero well in advance of return movement of the slide to the level of breakthrough, as shown by curve L2 in the graph of FIG. 3. In the preferred embodiment, the ratio of 4:1 with respect to the areas of flow across valve 88 provides the foregoing quick response and energy dampening by which the desired results are achieved.

While considerable emphasis has been placed on the specific embodiments herein illustrated and described, it will be appreciated that many modifications will be obvious and suggested upon reading the foregoing description and can be made without departing from the principles of the present invention. In this respect, for example, it will be appreciated that variable volume devices other than piston-cylinder units can be employed and that, in connection with piston-cylinder units, the piston-cylinder relationship can be reversed so that the cylinder is a movable component engaged by the press slide. As many possible embodiments of the present invention may be made, and as many changes may be made in the embodiments herein illustrated and described, it is to be distinctly understood that the foregoing descriptive matter is to be interpreted merely as illustrative of the present invention and not as a limitation.

Having thus described the invention, it is claimed:

1. A hydraulic shock dampening system for a shearing press having frame means including bed means and supporting reciprocable slide means and wherein material is severed between cooperable shearing means supported by said bed and slide means, said system including hydraulic fluid receiving variable volume chamber means between said bed means and slide means and connected to a source of hydraulic fluid under pressure, said chamber means being operable under compression in response to breakthrough of material being sheared by said shearing means supported by said slide means to restrain the resulting accelerated movement of said slide means, fluid flow responsive valve means in fluid flow communication with said chamber means for controlling fluid flow therefrom, said valve means having first and second flow controlling positions and including means providing first and second flow passageway means thereacross respectively in said first and second positions, each said passageway means having a fixed area and the area of said second passageway means being substantially less than the area of said first passageway means, means biasing said valve means toward said first position prior to said accelerated slide movement, and said valve means being displaced from said first to said second position by fluid flowing from said chamber means in response to said accelerated movement of said slide.

2. The shock dampening system according to claim 1, wherein the ratio of the area of said first passageway means to said second passageway means is about 4:1.

3. The shock dampening system according to claim 2, wherein said means biasing said valve means toward said first position is spring means.

4. The shock dampening according to claim 1, wherein said valve means includes housing means having a fluid flow passageway extending therethrough, said passageway having inlet and outlet ends, valve seat means in said passageway between said ends thereof, and valve element means in said passageway and displaceable toward and away from said valve seat means, said valve element means in said first position of said valve means being spaced from said seat means in the direction toward said inlet end to provide said first passageway means, said valve element engaging said seat means in said second position and including means cooperable therewith to provide said second passageway means when said valve element means engages said seat means, and said means biasing said valve means toward said first position including means biasing said valve element means away from said seat means.

5. The shock dampening system according to claim 4, wherein said valve element means sealingly engages said seat means and said means cooperable with said seat means to provide said second passageway means is an orifice through said valve element means.

6. The shock dampening system according to claim 5, wherein said means biasing said valve element means away from said seat means is biasing spring means.

7. The shock dampening system according to claim 6, wherein the area of the flow path through said valve means with said valve element means spaced from said seat means to the area of said orifice through said valve element means is 4:1.

8. The shock dampening system according to claim 1, wherein said first passageway means and said biasing means provides fluid flow across said valve means below a given pressure drop prior to said acceleration of said slide, said given pressure drop being exceeded in response to said acceleration of said slide, whereby said valve means is displaced to said second position, and said second passageway means providing a pressure drop across said valve means at the point of breakthrough more than thirty times greater than said given pressure drop.

9. The shock dampening system according to claim 1, wherein the ratio of the areas of said first and second flow passageway means, the force of said biasing means, and the velocity of fluid flow from said chamber means in response to said accelerated slide movement provide for said valve means to be displaced from said first to said second position in about 0.001 second following material breakthrough.

10. In a hydraulic shock dampening system for a shearing press having frame means including bed means and supporting reciprocable slide means and wherein material is severed between cooperable shearing means supported by said bed means and slide means, said system including hydraulic fluid receiving variable volume chamber means between said bed means and said slide means and connected to a source of hydraulic fluid under pressure, fluid flow responsive valve means in fluid flow communication with said chamber means and having open and second positions with respect to fluid flow therefrom, said valve means being displaced from said open position to said second position by fluid flow from said chamber providing a given pressure drop across said valve means, said valve means being in said open position during severing of material and said chamber means being operable under compression during said severing to displace fluid across said valve means below said given pressure drop, said valve means being displaced from said open position to said second position by fluid flow from said chamber means immediately upon material breakthrough to restrain fluid flow from said chamber means for said chamber means to restrain the accelerated slide movement resulting upon breakthrough, the improvement comprising: said valve means including fixed restricted passageway means thereacross in said second position providing a second pressure drop across said valve means substantially greater than said given pressure drop.

11. The improvement according to claim 10, wherein the ratio of said second pressure drop to said given pressure drop is greater than 30:1.

12. The improvement according to claim 10, wherein said valve means includes housing means having a flow passageway therethrough, valve seat means in said passageway, valve element means having a first position spaced from said seat means and a second position engaging said seat means, spring means biasing said valve element means toward said first position thereof, said first and second positions of said valve element means corresponding to said open and second positions of said valve means, and said fixed restricted passageway means being an orifice through said valve element means.

13. The improvement according to claim 12, wherein said valve seat means and said valve element means in said first position thereof provide a flow path area through said valve means, and the ratio of said area and the area of said orifice to the area of said orifice is about 4:1.

* * * * *

UNITED STATES PATENT AND TRADEMARK OFFICE

CERTIFICATE OF CORRECTION

PATENT NO. : 4,339,975

DATED : July 20, 1982

INVENTOR(S) : Louis F. Carrieri

It is certified that error appears in the above-identified patent and that said Letters Patent are hereby corrected as shown below:

Column 9, line 50, reference numeral 84 should read 86,
Column 11, line 29, after "dampening" insert --- system ---.

Signed and Sealed this

*Twenty-fifth* Day of *October 1983*

[SEAL]

*Attest:*

GERALD J. MOSSINGHOFF

*Attesting Officer*

*Commissioner of Patents and Trademarks*